United States Patent [19]

Gardner

[11] Patent Number: 4,879,702

[45] Date of Patent: Nov. 7, 1989

[54] WRIST WATCH

[76] Inventor: Kenneth H. Gardner, P.O. Box 1276, Bridgetown, Barbados

[21] Appl. No.: 209,731

[22] Filed: Jun. 22, 1988

[30] Foreign Application Priority Data

Jun. 26, 1987 [GB] United Kingdom ..... 8715065

[51] Int. Cl.[4] ..... G04B 37/00

[52] U.S. Cl. ..... 368/282; 368/281

[58] Field of Search ..... 368/281, 282

[56] References Cited

U.S. PATENT DOCUMENTS

| | | | |
|---|---|---|---|
| 2,226,138 | 12/1940 | Prestinari | 368/281 |
| 2,553,089 | 5/1951 | Holder | 368/282 |
| 4,412,751 | 11/1983 | Jeannet et al. | 368/282 |
| 4,575,833 | 3/1986 | Bakhtiari | 368/282 |
| 4,627,739 | 12/1986 | Shingo et al. | 368/282 |

FOREIGN PATENT DOCUMENTS

| | | | |
|---|---|---|---|
| 2837056 | 6/1980 | Fed. Rep. of Germany | 368/281 |

*Primary Examiner*—Bernard Roskoski

*Attorney, Agent, or Firm*—Fleit, Jacobson, Cohn, Price, Holman & Stern

[57] ABSTRACT

A wrist watch has a watch body and wrist band arranged to hold the watch body at the side of the wearer's wrist. In a preferred embodiment, this is achieved by providing the wrist band with a rigid portion, for example, where the watch body would lie in a conventional wrist watch, with a length sufficient to prevent rotation of the watch body around the wrist. In another preferred embodiment the watch body is incorporated in a resilient clip-on type band shaped as an elongate U.

13 Claims, 2 Drawing Sheets

WRIST WATCH

BACKGROUND OF THE INVENTION

This invention relates to a wrist watch. Conventionally, wrist watches are arranged to be worn on the back of the wrist, i.e., that part of the wrist which extends into the back of the hand, or sometimes the front of the wrist, i.e., that part of the wrist which extends into the palm of the hand. A disadvantage with this arrangement is that, in order to read the watch, the wrist must be turned until the back or the front, as the case may be, faces the eyes. This movement can be inconvenient or undesirable, for example in the case of a motor vehicle driver with hands on the steering wheel, or socially embarrassing, by making it obvious that the wearer is checking the time.

SUMMARY OF THE INVENTION

The present invention overcomes the above difficulties by providing a wrist watch having a watch body and a wrist band, the watch body and wrist band being adapted to hold the watch body at the side of the wearer's wrist.

In one preferred embodiment of the invention, the wrist band comprises a relatively less flexible portion extending over sufficient of the circumference of the band to prevent rotation of the watch around the wrist. For example, a rigid or semi rigid plate area extends from a hinged or flexible connection with the watch body over the back of the wrist, a flexible area of the band extending around the opposite side of the wrist and across the face of the wrist to connect to the other side of the watch body. This plate may be a separate metal or plastic member, or may be simply a thickening of a molded plastic band to decrease the flexibility over a predetermined length.

The watch body is suitably formed with a curved underside to conform with the side of the wrist, and in another preferred embodiment of the invention the watch body is held on the side of the wearer's wrist by virtue of this curved shape and with the aid of a less flexible curved portion of the wrist band arranged generally diametrically opposite the watch body, generally conforming to the opposite side of the wrist.

The watch body may conveniently be formed in a long and narrow shape and if the body is made sufficiently narrow, the underside thereof may be generally flat. The watch body suitably comprises an electronic mechanism with a digital display, although a suitably adapted analogue display could be used. The electronic watch mechanism may otherwise be conventional, but may be combined with an electronic calculator and/or electronic information storage device. The electronic watch mechanism may be powered by an electric cell within the body, or by photovoltaic panels mounted on the exterior of the watch body. Alternatively, where the wrist band is provided with a rigid or semi-rigid portion on the back of the wrist, the photvoltaic cells may be mounted on this portion. As a further alternative, or additionally, this rigid or semi-rigid portion of the wrist strap may also be used for mounting a miniature electronic calculator, radio receiver or even a television receiver, or a simple plate recording identity, medical or other data from ready reference, or simply for mounting decoration.

The relatively more flexible parts of the band may be formed of leather, fabric, plastics material or metal links and with suitable materials, such as fabrics and metal links, may be made elastic.

In another preferred embodiment of the invention, a watch body is incorporated in a resilient clip-on type watch band substantially in the shape of an elongate U, which may be of metal or plastic, the watch body being located substantially at the base of the U and the band being shaped and sized to clip onto a user's wrist from the side of the wrist, so as to retain the watch body at the side of the wrist when worn.

An advantage of wrist watches of the invention is that they may be read easily without the need to turn the wrist from the typical rest position with the side of the wrist upwards. The watches are less vulnerable to knocks or abrasion than with a conventional watch.

DESCRIPTION OF THE PREFERRED EMBODIMENT

Figure 1:
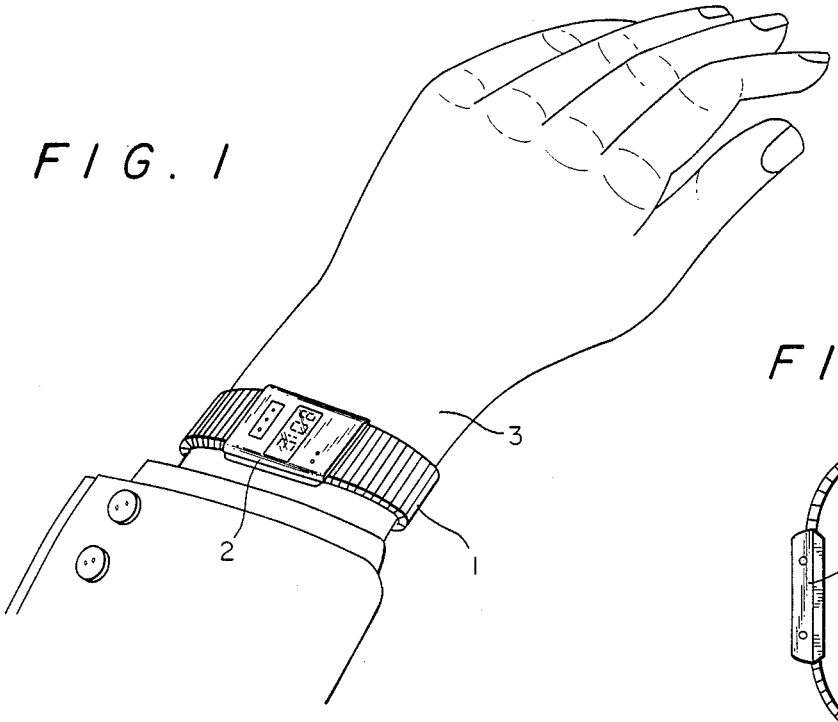
FIG. 1 a perspective view of a conventional wrist watch on a wearer's wrist.
Figure 2:
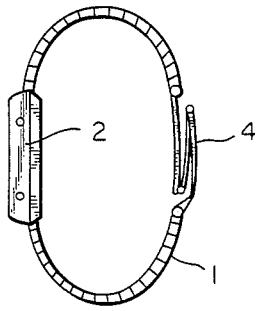
FIG. 2 is a side view of the conventional watch in the same configuration as when on the wearer's wrist, as shown in FIG. 1.

FIGS. 1 and 2 show a typical digital electronic watch provided with a flexible watch strap, worn on the wrist so that the watch body 2 lies on the back of the wrist 3. The strap 1 is formed in two parts, connectable by a clasp 4. It will be seen that, with the arm in the normal rest position wherein the side of the wrist is uppermost, it is necessary to turn the wrist through approximately a right angle to permit the watch to be read.

Figure 3:
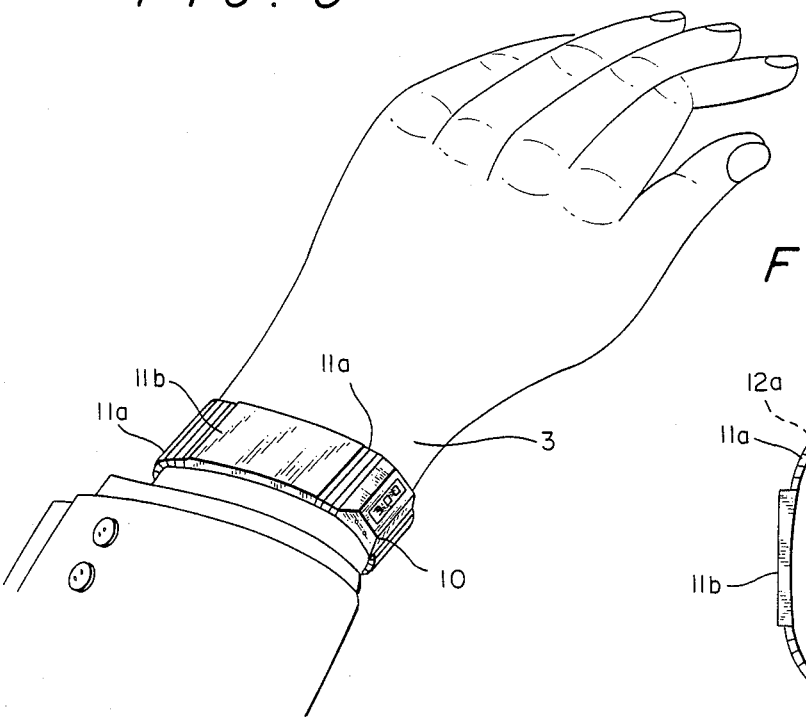
FIG. 3 is a perspective view, corresponding to that of FIG. 1, showing a watch according to one embodiment of the invention.
Figure 4:
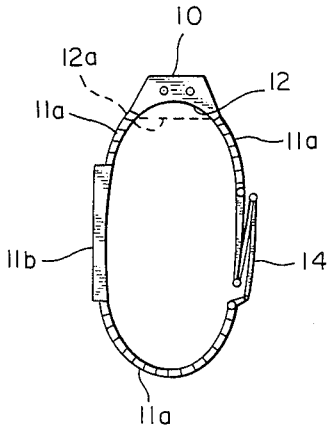
FIG. 4 is a side view corresponding to FIG. 2 of the watch shown in FIG. 3.
Figure 5:
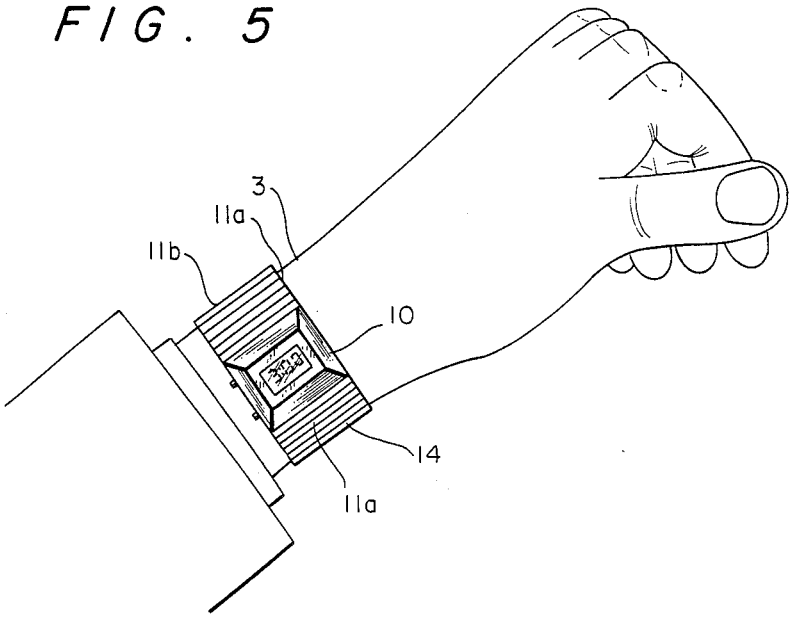
FIG. 5 is a view looking at the side of the wearer's wrist showing the watch illustrated in FIG. 3 and 4.

Referring now to FIGS. 3 and 5, which show a watch in accordance with an embodiment of the invention, the watch comprises a watch body 10 and a wrist band 11. The watch body 10 has a narrow rectangular shape, with an incurved underside 12, but may be flat, as indicated by dotted line 12*a*. The wrist band 11 comprises flexible portions 11*a* formed, for example of metal links, and as best seen in FIG. 4, a rigid or semi-rigid portion 11*b* positioned so as on the back of the wrist, in use. The rigid or semi-rigid portion 11*b* is suitably formed of plastics or metal and is linked to the watch body through a short flexible portion 11*a*. The length of the rigid or semi-rigid portion 11*b* is sufficient to prevent the watch body from rotating around the wrist away from the side position, for example 30 to 50 mm. The band is generally in elastic and is formed in two parts, with a connecting clasp 14 positioned on the band so as to adopt the conventional position at the center of the front of the wrist. This clasp may be slightly elongated so as to provide a rigid portion which assists in maintaining the position of the watch body on the side of the wrist, or it may serve in place of the rigid portion 11*b* on the back of the wrist.

Figure 7:
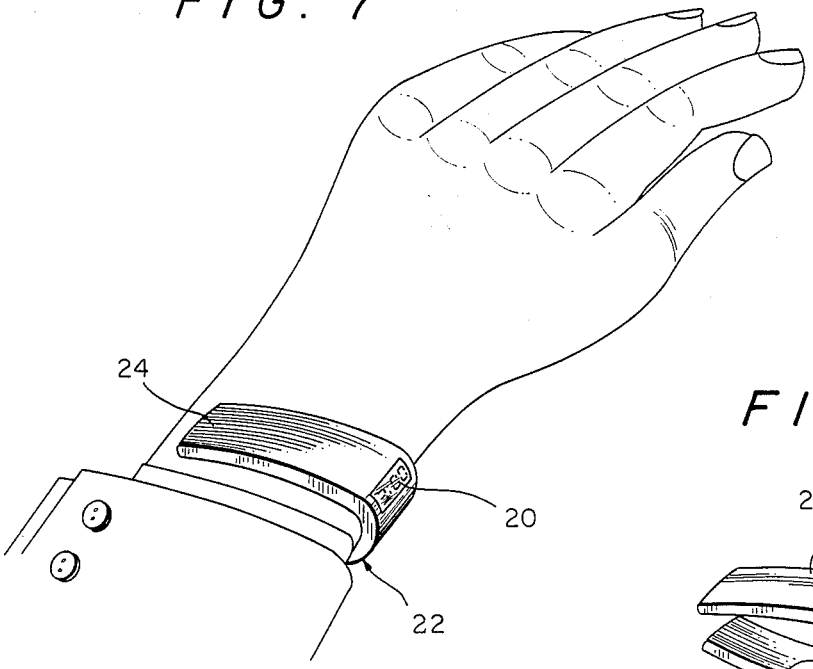
FIG. 7 is a perspective view of the watch shown on a wearer's wrist.
Figure 6:
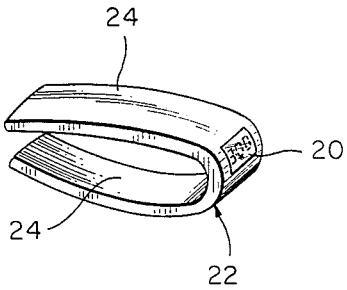
FIG. 6 is a perspective view of another type of watch according to the invention.

FIGS. 6 and 7 show another embodiment of the invention in which a watch body 20, which may be an electronic or mechanical movement module, is incorporated in a clip-on type watch band 22 which is substantially in the shape of an elongate U. The band may be molded in plastic or rubberized plastic or may be metal. The watch body is located at the base of the U and the band is configured with resilient limbs 24, so that it can clip onto a user's wrist from the side (FIG. 7) and hold the watch body uniquely in position at the side of the wrist due to the shape and resilience of the limbs 24. It will be evident that this form of watch has the same advantages as the watch described in relation to FIGS. 3 to 5.

The invention also provides a wrist band for a wrist watch, the band being adapted to hold a watch body attached thereto or mounted thereon at the side of the wearer's wrist.

The invention further provides a watch body adapted to be worn on the side of the wearer's wrist, for example being formed with a dimension along with the wrist greater than that perpendicular thereto, and with an incurved underside.

What is claimed is:

1. A wrist watch having a watch body and a flexible wrist band, the watch body and wrist band being adapted, to hold the watch body at the side of a wear's wrist, wherein the wrist band includes a closure means and a substantially flat relatively less flexible portion separated from the watch body by a flexible portion of the band, the less flexible portion extending over sufficient of the circumference of the band to lie on an elongate portion of the wearer's wrist to locate the watch body at the side of the wrist and to prevent rotation of the watch around the wrist.

2. A wrist watch according to claim 1, wherein the watch body is incurved on the underside thereof.

3. A wrist watch according to claim 1, wherein the band comprises a relatively less flexible curved member arranged diametrically opposite to the watch body.

4. A wrist watch according to claim 3, wherein the less flexible curved member is an integral part of the band.

5. A wrist watch according to claim 1, wherein the relatively less flexible portion is rigid.

6. A wrist watch according to claim 5, wherein the relatively less flexible portion is formed of a plastic material.

7. A wrist watch according to claim 5, wherein the relatively less flexible portion is formed of metal.

8. A wrist watch according to claim 1, wherein the band is formed in two parts connectable together by means of a connector positioned so as to be on the front of the wearer's wrist, in use.

9. A wrist watch according to claim 8, wherein the connector is a buckle or clasp.

10. A wrist watch according to claim 1, wherein the band is in the form of an elasticated bracelet.

11. A wrist watch according to claim 1 wherein the relatively less flexible portion has a length in the range 30–50 mm.

12. A wrist watch comprising a watch body and a flexible watch band for encircling a wearer's wrist, wherein the band includes a closure means and a substantially flat, substantially rigid member separated from the watch body by a flexible portion of the band, for lying against an elongate section of the wearer's wrist and locating the watch body at one side of the wrist.

13. A wrist watch according to claim 12 wherein the rigid member has a length in the range 30–50 mm.

* * * * *